US009518475B2

(12) United States Patent
Weber et al.

(10) Patent No.: US 9,518,475 B2
(45) Date of Patent: Dec. 13, 2016

(54) RE-USE OF INTERNAL COOLING BY MEDIUM IN TURBINE HOT GAS PATH COMPONENTS

(71) Applicant: General Electric Company, Schenectady, NY (US)

(72) Inventors: David Wayne Weber, Simpsonville, SC (US); Gregory Thomas Foster, Greer, SC (US); Aaron Ezekiel Smith, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 533 days.

(21) Appl. No.: 14/064,918

(22) Filed: Oct. 28, 2013

(65) Prior Publication Data

US 2015/0118022 A1 Apr. 30, 2015

(51) Int. Cl.

*F01D 9/04* (2006.01)
*F01D 11/24* (2006.01)
*F01D 11/00* (2006.01)

(52) U.S. Cl.

CPC ..... *F01D 11/24* (2013.01); *F01D 9/04* (2013.01); *F01D 11/005* (2013.01); *F05D 2240/11* (2013.01); *F05D 2240/81* (2013.01); *F05D 2260/205* (2013.01)

(58) Field of Classification Search

CPC ..... F01D 9/04; F01D 11/005; F01D 25/12; F05D 2240/11; F05D 2240/81; F05D 2260/205

See application file for complete search history.

(56) References Cited

U.S. PATENT DOCUMENTS

| | | | | |
|---|---|---|---|---|
| 3,752,598 | A * | 8/1973 | Bowers | F01D 5/3007 415/115 |
| 5,088,888 | A * | 2/1992 | Bobo | F01D 11/005 277/644 |
| 5,713,205 | A | 2/1998 | Sciocchetti et al. | |
| 5,782,626 | A | 7/1998 | Joos et al. | |
| 6,068,470 | A | 5/2000 | Zarzalis et al. | |
| 6,340,285 | B1 * | 1/2002 | Gonyou | F01D 11/005 415/116 |
| 7,217,081 | B2 * | 5/2007 | Scheurlen | F01D 11/008 277/642 |

(Continued)

FOREIGN PATENT DOCUMENTS

| | | |
|---|---|---|
| GB | 2 404 976 | 2/2005 |
| WO | 2007/104599 | 9/2007 |
| WO | 2011/052416 | 5/2011 |

*Primary Examiner* — Ninh H Nguyen

(74) *Attorney, Agent, or Firm* — Nixon & Vanderhye P.C.

(57) ABSTRACT

In one example, an arcuate segment for a ring-shaped, rotary machine component such as a stator nozzle or bucket shroud, includes a segment body having an end face formed with a circumferentially-facing seal slot adapted to receive a seal extending between the segment body and a corresponding seal slot in an adjacent segment body to seal a radially-extending gap between the adjacent segment bodies. A cooling channel is provided in the segment body in proximity to the seal slot, and is adapted to be supplied with cooling air. A passage extends from the cooling channel into the seal slot, at a location where the cooling air can be supplied to the higher pressure area on the radially-outer side of the seal.

17 Claims, 4 Drawing Sheets

(56) References Cited

U.S. PATENT DOCUMENTS

| | | | | |
|---|---|---|---|---|
| 7,434,401 | B2 | 10/2008 | Hayashi | |
| 8,128,344 | B2 * | 3/2012 | McGovern | F01D 11/08 415/116 |
| 8,347,631 | B2 | 1/2013 | Bailey et al. | |
| 8,555,648 | B2 | 10/2013 | Khosla et al. | |
| 2009/0255262 | A1 | 10/2009 | McMasters et al. | |
| 2010/0223929 | A1 | 9/2010 | Bailey et al. | |
| 2011/0067414 | A1 * | 3/2011 | Matwey | F01D 11/001 60/805 |
| 2012/0177479 | A1 * | 7/2012 | Azad | F01D 5/187 415/115 |
| 2012/0222649 | A1 | 9/2012 | Kudoh | |
| 2014/0096502 | A1 | 4/2014 | Karlsson et al. | |

* cited by examiner

RE-USE OF INTERNAL COOLING BY MEDIUM IN TURBINE HOT GAS PATH COMPONENTS

The present invention relates generally to cooling turbine engine components and, more specifically, to reducing secondary cooling flows in the area of seals between shrouds and shroud segments that are used to prevent ingress of high-pressure compressor air into the hot combustion gas path.

BACKGROUND OF THE INVENTION

In general, gas turbines combust a mixture of compressed air and fuel to produce hot combustion gases. The combustion gases may flow through one or more turbine sections to generate power to drive a load, such as an electrical generator and/or a compressor. Within the gas turbine sections, the combustion gases typically flow through one or more stages of nozzles and blades (or buckets). The turbine nozzles may include circumferential rings of stationary vanes that direct the combustion gases to the rotating blades or buckets attached to the turbine rotor. The combustion gases drive the buckets to rotate the rotor, thereby driving the load. The hot combustion gases are contained using seals between circumferentially-adjacent arcuate segments of stationary shrouds surrounding the nozzle vanes and/or buckets; between the platforms of circumferentially-adjacent rotating buckets or bucket segments on a rotor wheel; and seals between axially adjacent nozzle and bucket shrouds of the same or successive turbine stages.

The seals are designed to prevent or minimize ingestion of higher-pressure compressor discharge or extraction flows into the lower-pressure hot gas path. Nevertheless, leakage about the seals is inevitable and results in reduced compressor performance which contributes to an overall reduction in the efficiency of the turbine.

At the same time, the hot gas path components, including the shroud segments, buckets and seals must be cooled to withstand the extremely high combustion gas temperatures. Conventional cooling schemes usually involve some combination of internal cooling features and associated cooling technique (for example, impingment, serpentine, pin-fin bank, near-wall cooling) where the cooling air is eventually exhausted through film-cooling holes that enable additional cooling of the surface of the component, or exhausted into the hot gas path. In some instances, however, it is not desirable to exhaust all or part of the internal cooling flow in this manner.

While various techniques have been employed to cool the shrouds, buckets and associated seals, it remains desirable to provide enhanced cooling for the shrouds, buckets and/or seals, and to use the heated or spent cooling air for at least one other purpose, for example, to further reduce the leakage of compressor air into the hot gas path.

BRIEF DESCRIPTION OF THE INVENTION

In one exemplary aspect, the invention provides an arcuate segment for a ring-shaped, rotary machine component comprising a segment body having an end face formed with a circumferentially-facing seal slot adapted to receive a seal extending between the segment body and a corresponding seal slot in an adjacent segment body to seal a radially-extending gap between the adjacent segment bodies, and wherein, in use, the seal separates relatively higher and lower pressure areas in the radially-extending gap, on radially outer and radially inner sides respectively, of the seal; a cooling channel provided in the segment body in proximity to the seal slot, adapted to be supplied with cooling air; and a passage extending from the cooling channel into the seal slot at a location enabling supply of cooling air to the higher pressure area on the radially-outer side of the seal.

In another aspect, the invention provides an annular turbine component comprising plural arcuate segments arranged to form a complete annular ring, each segment having end faces provided with seal slots; a seal extending between seal slots of adjacent segments sealing radially oriented gaps between the segments; a channel provided in each segment in proximity to at least one of the seal slots, and adapted to be supplied with cooling air; and a passage extending from the channel and opening into the at least one seal slot on a radially-outer, high-pressure side of the seal.

In still another aspect, there is provided a gas turbine stator comprising first and second axially adjacent, annular shrouds having opposed end faces provided with respective seal slots; wherein a circumferential, axially-extending gap is formed between the opposed end faces; a circumferential seal seated in the respective seal slots to thereby seal the axially-extending gap, the seal, in use, separating relatively higher and lower pressure areas on radially-outer and radially-inner sides thereof; and one or more cooling channels provided within each of the first and second axially-adjacent, annular shrouds adapted to be supplied with cooling air, the one or more cooling channels arranged to introduce cooling air into a respective one of the seal slots in the relatively higher pressure area on the radially-outer side of the seal.

The invention will now be described in greater detail in connection with the drawings identified below.

DETAILED DESCRIPTION OF THE INVENTION

Figure 1:
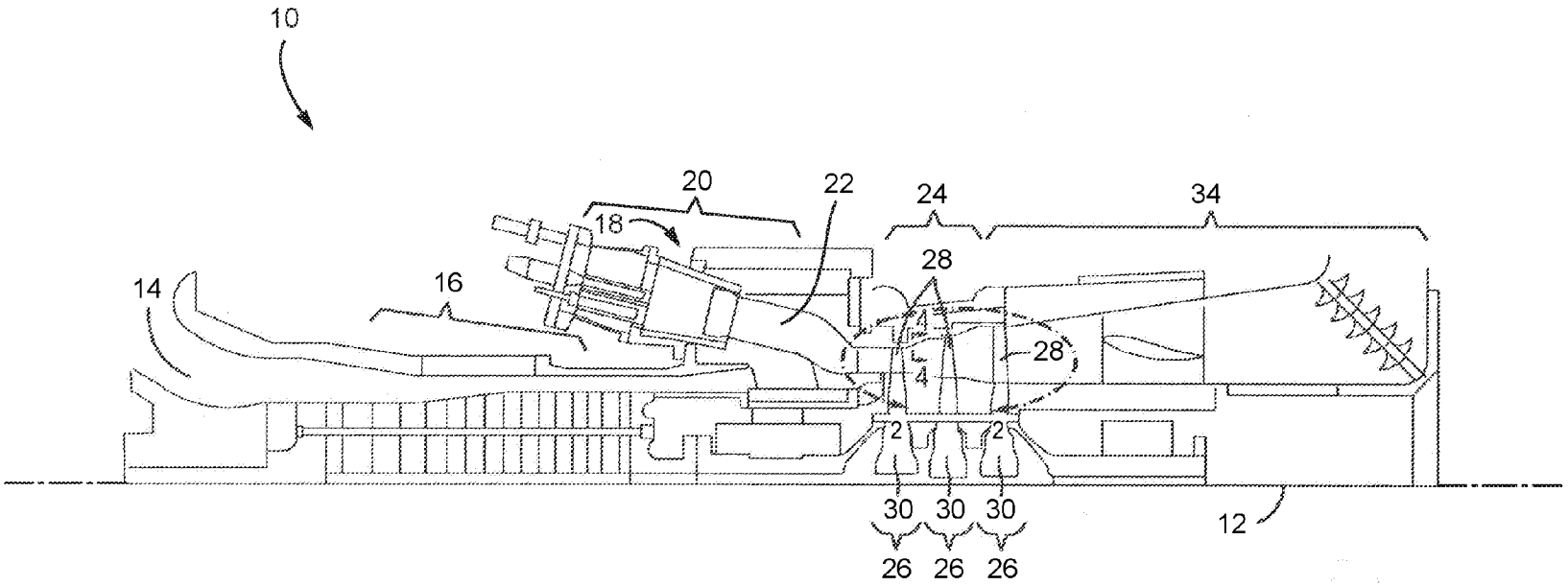
FIG. 1 is a partial sectional view of a gas turbine engine, taken along an axis of rotation of the turbine rotor.

FIG. 1 is a cross-sectional side view of a conventional gas turbine engine 10 taken along a longitudinal axis 12, i.e., the axis of rotation of the turbine rotor. With reference also to the enlarged detail in FIG. 2, it will be appreciated that air enters the gas turbine engine 10 through the air intake section 14 of a compressor 16. The compressed air exiting the compressor 16 is directed to the combustors 18 (one shown) to mix with fuel which combusts to generate hot combustion gases. Multiple combustors 18 may be annularly disposed within the turbine combustor section 20, and each combustor 18 may include a transition piece 22 that directs the hot combustion gases from the respective combustor 18 to the gas turbine section 24. In other words, each transition piece 22 defines a hot gas path from its respective combustor 18 to the turbine section 24.

The illustrated, exemplary gas turbine section 24 includes three separate stages 26. Each stage 26 includes a set or row of buckets 28 coupled to a respective rotor wheel 30 that is rotatably attached to the turbine rotor or shaft represented by the axis of rotation 12. Between each wheel 30 is a set of nozzles 40 incorporating a circumferential row of stationary vanes or blades 42. The nozzle vanes 42 are supported between segmented, inner and outer stator shrouds or side walls 44, 46, each segment incorporating one or more vanes, while the buckets 28 are surrounded by stationary, stator shroud segments 48. The nozzle and bucket shrouds serve to contain the hot combustion gases and allow a motive force to be efficiently applied to the buckets 28. The hot combustion gases exit the gas turbine section 24 through the exhaust section 34.

Applications for the present invention relate to seals extending across radially-oriented gaps between circumferentially-adjacent nozzle vane and/or bucket shroud segments; between circumferentially-adjacent buckets; and between axially-adjacent shrouds (nozzle and bucket) in the same or adjacent stage.

It will be understood, of course, that although the turbine section 24 is illustrated as a three-stage turbine, the cooling and sealing arrangements described herein may be employed in turbines with any number of stages and shafts, e.g., a single stage turbine, a dual turbine that includes a low-pressure turbine section and a high-pressure turbine section, or in a multi-stage turbine section with three or more stages. Furthermore, the cooling and sealing arrangements described herein may be utilized in gas turbines, steam turbines, hydroturbines, etc.

Typically, discharge air from the compressor 16 (FIG. 1), which may act as a cooling fluid, is supplied to internal cooling circuits in the stationary vanes 42, the inner and outer band segments 44 and 46, and/or the bucket shroud segments 48 (FIG. 2) to provide the required cooling of these components. In FIG. 3, a seal cavity 50 is shown that is adapted to receive a seal extending between axially-adjacent shrouds 54, 56. Seal cavities 52, 53 are adapted to receive seals between circumferentially-adjacent segments of the shrouds 54, 56, respectively. These are just two of several locations where cooling flow circuits and seal cavities as described herein may be used to not only perform a cooling function, but also serve an additional function by using the heated or spent cooling air to replace the leakage flow in the higher-pressure areas of the radially-oriented gaps between segments and/or axially-oriented gaps between axially-adjacent shrouds.

Figure 4:
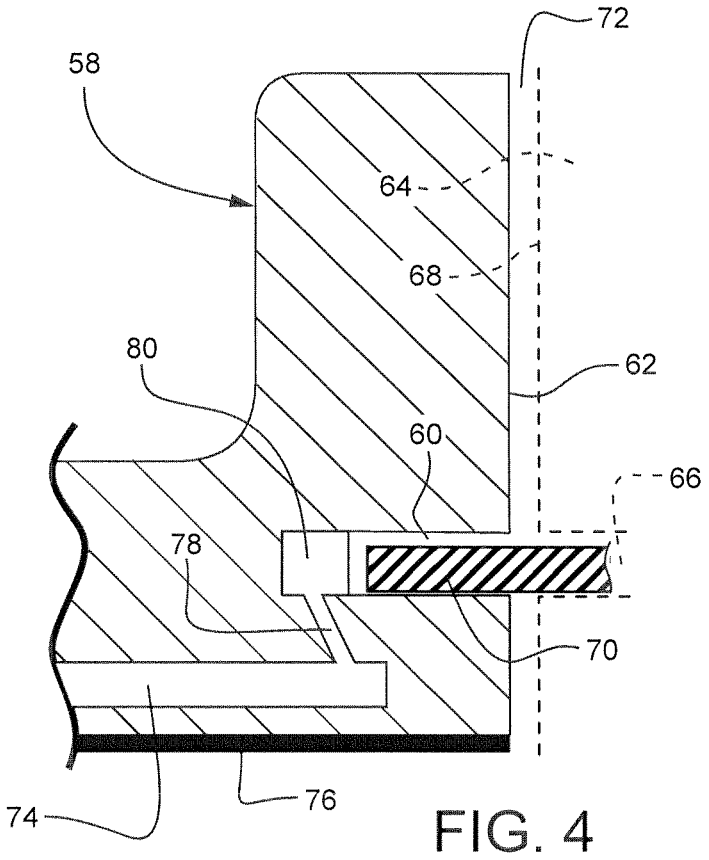
FIG. 4 is a partial section of a stator shroud segment illustrating a shroud internal cooling circuit adjacent a shroud segment seal cavity and seal in accordance with a first exemplary but nonlimiting embodiment.

Turning to FIG. 4, a nozzle vane shroud segment 58 is formed or provided with a seal slot 60 along an edge face 62. An adjacent segment 64 has a similar seal slot 66 provided in the opposing edge face 68. A seal 70 bridging the gap 72 between the edge faces 62, 68, is seated in the respective opposed slots 60, 66 and is intended to block the flow of higher-pressure compressor air radially inwardly into the hot gas path. FIG. 4 also shows a cooling passage or cavity 74 which is located to cool the radially-inner surface 76 of the shroud segment 58. Note that surface 76, which is exposed to hot combustion gases, may be coated with a thermal barrier coating (TBC).

Rather than simply exhausting the spent cooling air into the hot gas path, a further passage 78 is provided to connect the cooling passage or cavity 74 to a plenum or cavity 80 which permits introduction of the spent cooling air at a location upstream of the seal 70 (on the high-pressure side of seal, i.e., above the seal as viewed in FIG. 4). It will be understood that similar plenums or cavities are provided at spaced locations along the length of the seal slot. By periodically relieving the side surface of the seal slot to form the plenums 80, the seal is retained in place (and prevented from blocking the passage(s) 78) while permitting the flow of spent cooling air into the segment gap 72 radially outward of the seal 70, thus serving to replace the higher-pressure compressor air that would otherwise leak past the seal 70. While the spent cooling air will eventually leak around the seal 70 and mix with the hot combustion gases, the continued exhausting of spent cooling air into the gap 72 via the passages 78 and plenums 80 outwardly of the seal 70, reduces secondary compressor flows and thus results in higher turbine efficiency.

Figure 2:
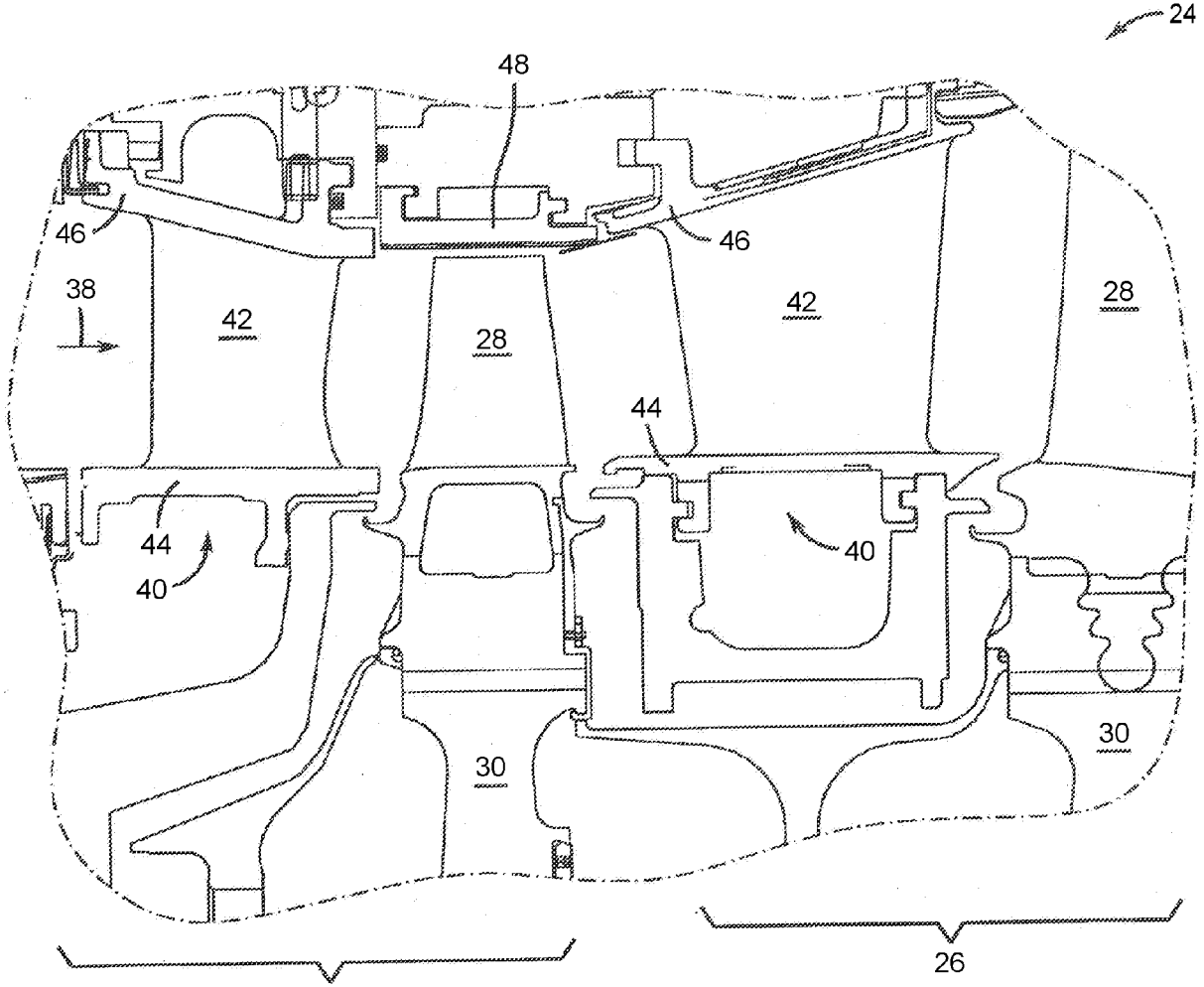
FIG. 2 is an enlarged detail of the encircled area indicated by reference numeral 2 in FIG. 1.
Figure 3:
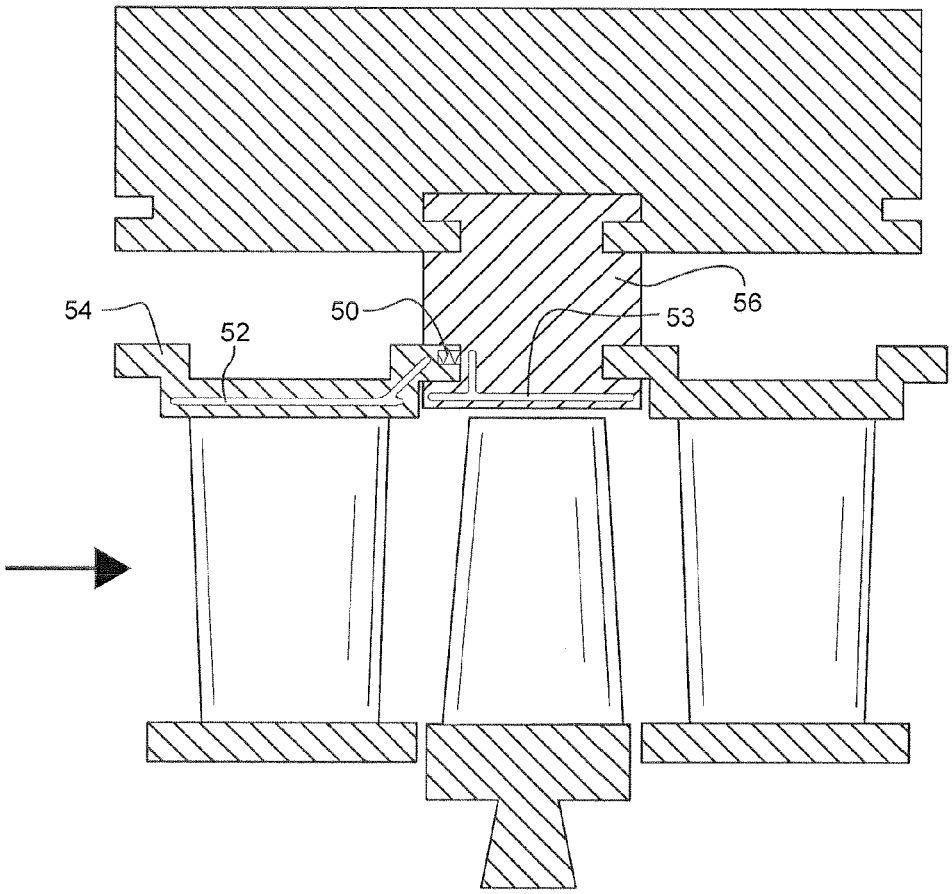
FIG. 3 is a simplified section view of turbine stator and rotor shrouds and exemplary locations where seals are used between adjacent segments.

It will be understood that a substantially similar arrangement may be provided between circumferentially-adjacent bucket shroud segments (for example, bucket shroud 48 in FIG. 2 and bucket shroud 56 in FIG. 3); and between axially adjacent nozzle and bucket shrouds (e.g., between shrouds 46 and 48 in FIG. 2 or between shrouds 54 and 56 in FIG. 3). In the case of axially-adjacent shrouds, seal 70 (configured as a circumferential seal) could be considered as sealing an axial gap 72 between a nozzle shroud 58 and an axially-adjacent bucket shroud 64, recognizing that the opposed edge faces 62, 68 may not be as shown in FIG. 3.

Figure 5:
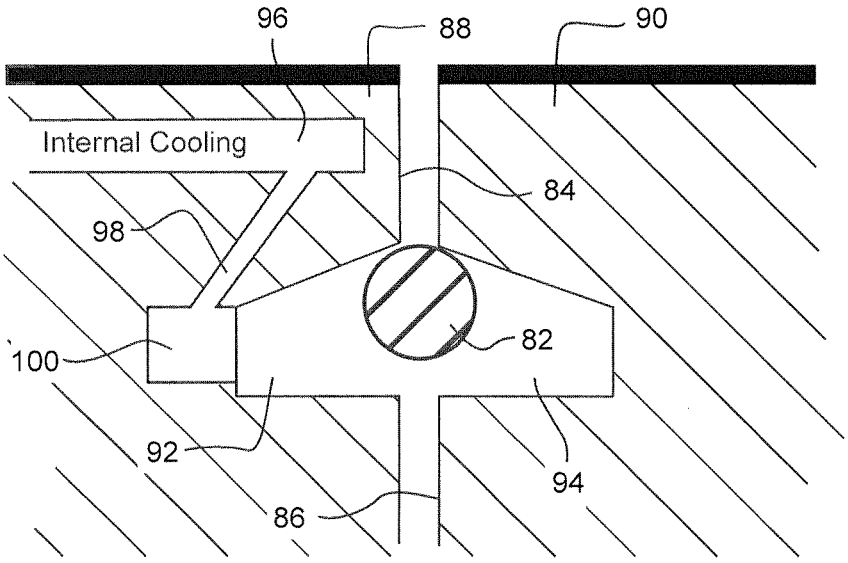
FIG. 5 is a partial section illustrating an internal cooling circuit adjacent a seal cavity and seal between adjacent rotor components in accordance with another exemplary but nonlimiting embodiment

This same concept can be applied to the seals extending along edges of circumferentially-adjacent buckets in an annular row of buckets mounted on a turbine rotor wheel. FIG. 5 illustrates an exemplary but nonlimiting embodiment where a damper pin/seal 82 extends in a generally axial direction along the opposite side edges 84, 86 of circumferentially-adjacent bucket platforms 88, 90, respectively, seated partially within opposed damper pin slots 92, 94. Secondary compressor flow used to cool the bucket platform 88, may be exhausted from cooling cavity 96 via passage 98 into a plurality of cavities or plenums 100 which introduce the spent cooling air to the high-pressure side of the seal 82 (the lower side as viewed in FIG. 5). A similar arrangement could be provided in the adjacent bucket platform 90. The manner in which the spent cooling flow is used to replace compressor leakage flow is substantially as described above in connection with the stationary stator nozzle and bucket shrouds.

It will be understood that other seal slot configurations may employed with the same result. For example, rather than discrete plenums periodically spaced along the length of the seal slot, the seal slot itself could be formed with an offset step or shoulder along the base of the slot which would provide the required space for receiving the spent cooling air on the high pressure side of the seal while also preventing lateral shifting of the seal within its respective opposed slots.

In all cases, by re-using spent cooling air as described herein, it is possible to reduce the overall amount of compressor extraction flow required for cooling and/or purging and thereby increase compressor and turbine efficiency.

While various embodiments are described herein, it will be appreciated from the specification that various combinations of elements, variations or improvements therein may be made by those skilled in the art, and are within the scope of the invention.

What is claimed is:

1. An arcuate segment for a ring-shaped, rotary machine component comprising:

a segment body having an end face formed with a circumferentially-facing seal slot adapted to receive a seal extending between said segment body and a corresponding seal slot in an adjacent segment body to seal a radially-extending gap between the adjacent segment bodies, and wherein, in use, the seal separates relatively higher and lower pressure areas in the radially-extending gap, on radially outer and radially inner sides respectively, of the seal;

a cooling channel provided in said segment body in proximity to said seal slot, adapted to be supplied with cooling air; and a passage extending from said cooling channel into said seal slot at a location enabling supply of cooling air to the higher pressure area on said radially-outer side of said seal;

wherein said cooling channel includes a radially inward wall and a radially outward wall, said radially inward wall and said radially outward wall are both radially outward of a radially inner surface of said segment body that is exposed to a hot air path, and said radially inward wall and radially outward wall of said cooling channel are both radially inward of said seal slot.

2. The segment of claim 1 wherein said passage opens on an axial edge of said seal slot.

3. The segment of claim 2 wherein said passage terminates at one or more plenums spaced along said axial edge.

4. The segment of claim 1 wherein said rotary machine component comprises a turbine stator nozzle shroud.

5. The segment of claim 1 wherein said rotary machine component comprises a turbine stator bucket shroud.

6. An annular turbine component comprising:

plural arcuate segments arranged to form a complete annular ring, each arcuate segment having end faces provided with seal slots; a seal extending between seal slots of adjacent segments sealing a radially oriented gaps between the arcuate segments;

a channel provided in each segment in proximity to at least one of said seal slots, and adapted to be supplied with cooling air; and a passage extending from said channel and opening into said at least one seal slot on a radially-outer, high-pressure side of the seal;

wherein said channel includes a radially inward wall and a radially outward wall, said radially inward wall and said radially outward wall are both radially outward of a radially inner surface of said arcuate segments that is exposed to a hot air path, said radially inward wall and radially outward wall of said cooling channel are both radially inward of said seal slot.

7. The annular turbine component of claim 6 wherein said plural arcuate segments combine to form an annular turbine stator nozzle shroud.

8. The annular turbine component of claim 6 wherein said plural arcuate segments combine to form an annular turbine stator bucket shroud.

9. The annular turbine component of claim 6 wherein said plural arcuate segments combine to form an annular row of buckets on a turbine rotor wheel, said end faces comprising bucket platform edges.

10. The annular turbine component of claim 6 wherein said passage terminates at one or more plenums spaced along a base of said at least one seal slot.

11. The annular turbine component of claim 6 wherein said passage terminates in said at least one seal slot, along an offset shoulder adapted to prevent said seal from blocking said passage.

12. A gas turbine stator comprising:

first and second axially adjacent, annular shrouds having opposed end faces provided with respective seal slots; wherein a circumferential, axially-extending gap is formed between said opposed end faces;

a circumferential seal seated in said respective seal slots to thereby seal said axially-extending gap, said seal, in use, separating relatively higher and lower pressure areas on radially-outer and radially-inner sides thereof; and one or more cooling channels provided within each of said first and second axially-adjacent, annular shrouds adapted to be supplied with cooling air, said one or more cooling channels arranged to introduce cooling air into a respective one of said seal slots in the relatively higher pressure area on said radially-outer side of said seal;

wherein said one or more cooling channels includes a radially inward wall and a radially outward wall, said radially inward wall and said radially outward wall are both radially outward of a radially inner surface of said shrouds that is exposed to a hot air path, and said radially inward wall and radially outward wall of the one or more cooling channels are both radially inward of said seal slot.

13. The gas turbine component of claim 12 wherein said one or more cooling channels communicate with a plurality of plenums spaced along an axially-facing edges of said respective seal slots.

14. The gas turbine component of claim 12 wherein said one or more cooling channels communicate with said respective seal slots along offset shoulders provided along axially-facing edges of said respective seal slots.

15. The gas turbine component of claim 12 wherein said first annular shroud comprises a stator nozzle shroud.

16. The gas turbine component of claim 15 wherein said second annular shroud comprises a stator bucket shroud.

17. The gas turbine component of claim 12 wherein each of said first and second annular shrouds is comprised of plural arcuate segments.

* * * * *